US010800124B2

(12) United States Patent
Haehl

(10) Patent No.: US 10,800,124 B2
(45) Date of Patent: Oct. 13, 2020

(54) HYDRAULIC DRIVE

(71) Applicant: HAWE HYDRAULIK SE, Munich (DE)

(72) Inventor: Alexander Haehl, Munich (DE)

(73) Assignee: HAWE HYDRAULIK SE, Munich (DE)

( * ) Notice: Subject to any disclaimer, the term of this patent is extended or adjusted under 35 U.S.C. 154(b) by 521 days.

(21) Appl. No.: 15/724,771

(22) Filed: Oct. 4, 2017

(65) Prior Publication Data

US 2018/0093440 A1 Apr. 5, 2018

(30) Foreign Application Priority Data

Oct. 4, 2016 (DE) ..... 10 2016 219 220

(51) Int. Cl.
*B30B 15/22* (2006.01)
*B30B 15/28* (2006.01)
(Continued)

(52) U.S. Cl.
CPC ..... *B30B 15/284* (2013.01); *B30B 15/22* (2013.01); *F15B 13/01* (2013.01); *F15B 15/204* (2013.01); *F15B 11/08* (2013.01); *F15B 13/024* (2013.01); *F15B 15/225* (2013.01); *F15B 2211/205* (2013.01); *F15B 2211/25* (2013.01)

(58) Field of Classification Search
CPC ..... B30B 15/16; B30B 15/22; B30B 15/284; F04B 3/00; F04B 5/00; F15B 13/01; F15B 15/204; F15B 11/08; F15B 13/024; F15B 15/225; F15B 2211/25; F15B 2211/205
See application file for complete search history.

(56) References Cited

U.S. PATENT DOCUMENTS 6,206,663 B1 * 3/2001 Frenken ..... F04B 3/00 417/262
6,666,064 B2 * 12/2003 LeFavour ..... B25B 27/10 29/751
(Continued)

FOREIGN PATENT DOCUMENTS

EP 1319475 A2 6/2003
EP 1 703 144 A1 9/2006

OTHER PUBLICATIONS

German Examination Report dated Sep. 19, 2017, application No. 10 2016 219 220.5, Applicant Hawe Hydraulik SE, 9 Pages.
(Continued)

*Primary Examiner* — Jimmy T Nguyen
(74) *Attorney, Agent, or Firm* — Brooks Kushman P.C.

(57) ABSTRACT

In a hydraulic drive of a tool piston in a cylinder first and second flat contact areas each are contiguous, when moving into and in the open position of the valve member between the detent element and the valve member, wherein a pressure-limiting valve that can be loaded with the pressure in the cylinder from a closed position to an open position and a detent element loaded by a spring in the locking direction to positively hold a neck of a valve member of the pressure-limiting valve are arranged in the open position, wherein the detent element at least via the tool piston at its return to a released position can be moved and, when moving the valve member to the open position of the pressure-limiting valve, non-positively acts on the valve member.

20 Claims, 4 Drawing Sheets

(51) Int. Cl.

| | |
|---|---|
| ***F15B 13/02*** | (2006.01) |
| ***F15B 15/20*** | (2006.01) |
| ***F15B 13/01*** | (2006.01) |
| *F15B 15/22* | (2006.01) |
| *F15B 11/08* | (2006.01) |

(56) References Cited

U.S. PATENT DOCUMENTS

| | | | | |
|---|---|---|---|---|
| 8,056,473 | B2 * | 11/2011 | Frenken | B30B 15/16 100/35 |
| 2001/0027676 | A1 * | 10/2001 | Frenken | B21J 15/26 72/453.15 |
| 2003/0126905 | A1 | 7/2003 | Frenken | |
| 2009/0133591 | A1 * | 5/2009 | Frenken | B25B 27/10 100/269.01 |

OTHER PUBLICATIONS

German Examination Report dated May 25, 2020 (with English Machine Translation), Application No. 10 2016 219 220.5, Applicant Hawe Hydraulik SE, 15 Pages.

* cited by examiner

HYDRAULIC DRIVE

CROSS-REFERENCE TO RELATED APPLICATIONS

This application claims foreign priority benefits under 35 U.S.C. § 119(a)-(d) to German patent application number DE 10 2016 219 220.5, filed Oct. 4, 2016, which is incorporated by reference in its entirety.

TECHNICAL FIELD

The disclosure relates to a hydraulic drive.

BACKGROUND

In the hydraulic drive known from EP 13 19 475 A1 the pump port opposite to the intersection point between the housing hole of the detent element and the hole for a valve member or cone of the pressure-limiting valve is offset toward the cylinder axis, which results in an unsuitable large overall length of the hydraulic drive toward the cylinder axis (FIG. 1). In the embodiments of FIGS. 2 to 12 having a detent element configured as a cylindrical pin with a blunt pin end, the pin in the locked position laterally engages a circumferential groove of the valve member, wherein the outer circumference of the pin end, with line contact, is pressed against a groove flank under the spring force of the pressure-limiting valve. On the other hand, when moving the valve member to the open position of the pressure-limiting valve, the blunt flat front end of the pin, with line contact, is pressed against the outer circumference of a cylinder portion of the valve member under the force of the spring loading the pin. When the pin upon reaching the open position of the pressure-limiting valve clicks into the circumferential groove under the force of the spring this takes place under the spring force of the pin with point contact between the edge of the pin end and the edge of the circumferential groove. When the pin in the return movement of the piston is retracted from the circumferential groove, then this is first done by pressing in the line contact and finally by pressing in the point contact between the edge of the pin end and the edge of the circumferential groove, namely under the substantial spring force of the pressure-limiting valve. These interactions between the pin and the valve member for example over millions of press cycles due to the pressing in the line and point contacts result in increasing wear and significant unilateral transverse forces, which undesirably affects the response characteristics of the pressure-limiting valve and its hysteresis. However, extraordinarily high demands are made on such pressing tools for pressing of e.g., cable lugs, clamps, sanitary fittings and the like, e.g., in view of the pressing power which must exactly be maintained, because decreasing pressing power may lead to loosening of cables and/or leakages on fittings or hose connections, whereas increasing pressing power may lead to damages of the pressed components, each with considerable consequential damages. In the known hydraulic drive the wear between pin outer side and groove flank results in a shortening of the opening stroke of the pressure-limiting valve and a reduction of the return velocity of the piston. The wear at the front end of the pin and in the cylinder jacket of the cylinder portion results in uncontrollably changing friction ratios, which may lead to the decrease or increase of the response pressure of the pressure-limiting valve. In particular, an uncontrollable change in the set or required pressing power, respectively, is critical, because it cannot be detected in operation, but only shows up much later on the pressed components.

SUMMARY

The disclosure is based on the task to provide a hydraulic drive of the initially mentioned type that is characterized in a precise maintenance of the set pressing power and toward the cylinder axis is build up in a compact manner.

Because all the interactions between the detent element and the valve member are via flat contiguous contact areas, possible wear is distributed over a large area and both the set response pressure of the pressure-limiting valve, its movements, and hysteresis and the return velocity of the tool piston are maintained unchanged over many press cycles. With the concept of the contiguous flat contact areas the hydraulic drive can be configured compact in the cylinder longitudinal direction via the thus possible port geometry, which saves weight on the pressing tool and improves its handling. Moreover, the contiguous flat contact areas ensure that eccentric loads and obstacles for the valve member are avoided as far as possible, since the flat contact areas are able to transmit forces largely symmetrically.

Suitably, the contact areas that are contiguous in the open position of the pressure-limiting valve and in the locked position of the detent element are even and in parallel. Preferably, they are formed approximately circular or as parts of an annulus. Thus, the optionally significant force of the spring of the pressure-limiting valve is absorbed over a large area and distributed over a large area when moving the detent element to and from the locked position.

Further it is suitable if the contact areas that are contiguous when moving the valve member to the open position of the pressure-limiting valve are partially cylindrical. In this way, the blocking of the valve member resulting from the contact pressure of the detent element remains constant over a large number of press cycles, so that neither hysteresis of the pressure-limiting valve nor its actual response pressure (the required pressing power) change.

In view of a compact size of the hydraulic drive in longitudinal direction of the cylinder it is particularly advantageous if the axes of a pump port, a housing hole of the detent element and a hole for the valve member intersect at right angles in one point. Said port geometry also offers considerable production-oriented advantages.

It may be appropriate if the housing hole and the hole are arranged in a valve insert that has the seat for the valve member and that can be prefabricated and ensures consistent sliding conditions. Thanks to the axes intersecting in one point the manufacturing costs for the hydraulic drive are significantly reduced.

In a particularly suitable embodiment the detent element is a longitudinally drilled cylindrical detent sleeve that is penetrated by the valve member in a transverse passage and the through-hole of which forms a part of a pressure line and a part of a return port. Since the diameter of the detent sleeve is larger than the diameter of the valve member suitably large contact areas are generated and above all a symmetric support of the valve member in the open position of the pressure-limiting valve. Since the detent sleeve at the same time forms parts of the pressure line and of the return port no further ports are required in the hydraulic drive, which also reduces manufacturing costs.

It is suitable to build the valve insert into a hydraulic drive block containing the pump port and preferably being connectable to the cylinder via one single hydraulic interface. In this way, the number of critical sealing points with regard to leakages is reduced to only some.

In the block it is possible to provide an easy-to-manufacture bypass of the valve insert from the pump port to the through-hole of the detent sleeve via which the pump feds without any noticeable throttling into the through-hole of the detent sleeve and therethrough into the cylinder.

In an advantageous embodiment the valve member following a cylindrical neck reduced in diameter has a cylindrical large-diameter collar, wherein its first and second flat contact areas are provided on the collar outer diameter and a radially oriented collar bottom side. On the other hand, the detent sleeve has its first and second flat contact areas within the passage and adjacent to the outside of the passage.

Suitably, in the detent sleeve the even second flat contact area is restricted from the edge of the passage and the bottom of an even flattening in parallel to the bottom side of the collar of the valve member in the cylinder jacket of the detent sleeve.

Here, the passage may be a cross hole at least corresponding to the outer diameter of the collar, and the arc curvature of the cross hole side with the wall thickness of the detent sleeve corresponding to the curvature of the outer diameter of the collar is configured where the first flat (cylindrical) contact area of the detent sleeve is present. At the cross hole side an approximately semicircular recess is formed in the region of the flattening the radius of which approximately corresponds to the cylinder radius of the neck of the valve member and that with the bottom of the flattening restricts the second flat contact area of detent sleeve. The recess can divide the first flat contact area of the detent sleeve into two relatively large sub-areas.

Suitably, the detent sleeve is guided without a seal with a slide fitting in the housing hole. This ensures a constant smooth movement of the detent sleeve. At the same time, here a critical sealing area is avoided. However, this should not exclude to seal the detent sleeve with an additional seal in the housing hole.

In order to open a flow path in the return port that is as little throttled as possible, it is suitable if a clearance forming an additional part of the return port is provided in the valve insert between the shank of the valve member leading to a sealing surface and the wall of the hole for the valve member up to the seat.

In order to be able to use a closing spring having a moderate spring force for the pressure-limiting valve it is favorable if the diameter of the seat in the valve insert is only slightly larger than the diameter of the neck of the valve member guided in the hole. In this way, the optionally high pressure in the cylinder acts on a relatively small sized circular surface.

The spring loading the detent element to the locked position can be assigned to the end of the detent element projecting into the cylinder on which the returning tool piston acts or to the end facing away from the cylinder. Said spring preferably can support itself in the block.

Simple in terms of manufacturing technology the detent sleeve has inlets to the through-hole that are distributed in the circumferential direction and that are optionally also offset to each other toward the axis of the detent sleeve, in order that the hydraulic fluid delivered by the pump can be supplied into the cylinder via the detent sleeve without notable throttling resistances.

Finally, it is suitable if the height of the hydraulic drive viewed in the longitudinal direction of the cylinder on the cylinder is smaller than the piston diameter of the piston moveable in the cylinder. This results in a compact size of the pressing tool.

An embodiment according to the disclosure is explained with respect to the drawings. Here, it is noted that the illustrations in the figures are strongly schemed, i.e., concretely built embodiments may deviate from this schematic illustration in details.

DETAILED DESCRIPTION

Figure 1:
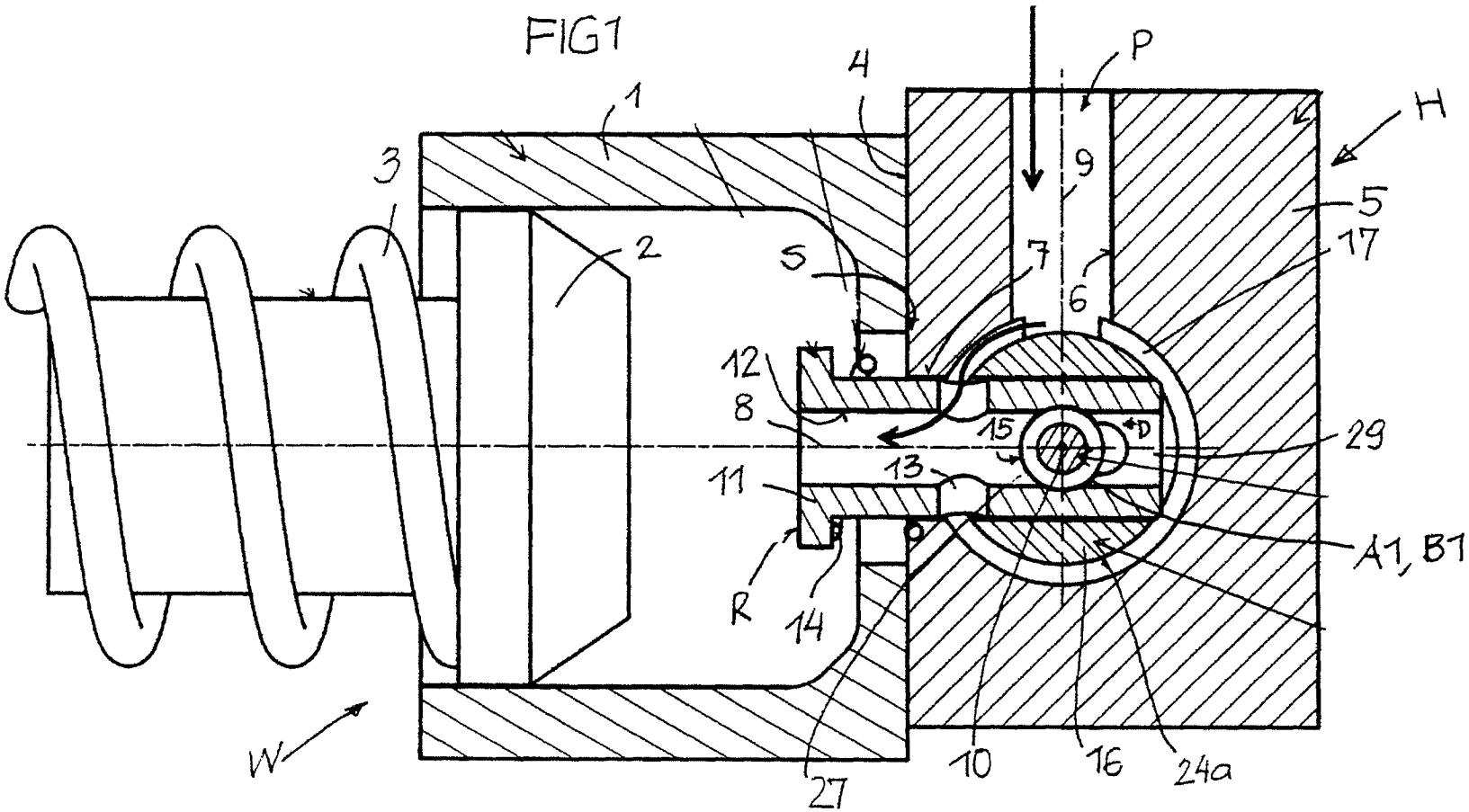
FIG. 1 shows a part of a pressing tool equipped with a hydraulic drive in section and in an operating phase before reaching a required pressing power.

FIGS. 1 to 5 illustrate a hydraulic drive H of a pressing tool W as well as components of the hydraulic drive H. Such pressing tools W are used to press cable lugs, fittings, clamps and the like, for example, are usually portable, and are hydraulically driven. In order to generate sufficient pressing forces pressures up to 700 bar are used that are applied by a pump that is electrically driven (from a net or a power pack), for example. As soon as in a press cycle the required pressing power has been reached that is generated by a tool piston 2 that is slidable against a return spring 3 in a cylinder 1, the pressing tool W switches off independently and the tool piston 2 returns under the force of the return spring 3. Then, the pressing tool W is ready for a new press cycle. Here, the important thing is i.e., that the set pressing power is precisely achieved over many press cycles, the tool piston 2 return with a set return velocity, and in a new press cycle the pressing power is reached again as soon as possible.

On the pressing tool W on the cylinder 1 at a single hydraulic interface 4 there is mounted the hydraulic drive H the components of which are accommodated in a block 5 that is surrounded by a reservoir (not shown) for a hydraulic fluid, for example made of an elastic material, and carries or contains the pump (not shown) with its drive motor.

In block 5 a pump port 6 is laterally drilled into which the pump P feeds hydraulic fluid for a press cycle (arrows in FIG. 1). Pump P sucks in from the reservoir via a not shown suction valve and presses the hydraulic fluid via a not shown pressure valve into the pump port 6. In a housing hole 7 in block 5 a detent element R, here a longitudinally drilled detent sleeve 11, is slidably guided (e.g., slide fitting without a seal) that penetrates a valve insert 16 mounted in a hole 24*a*. In the valve insert 16 holes 24, 25 with a seat 18 for a valve member 15 of a pressure-limiting valve D are provided. The valve member 15 is loaded by a spring 21 in the direction of the arrow in FIG. 2.

Axes 8, 9, 10 of the pump port 6, the housing hole 7, and the hole 24*a*, 24, 25 for example are at right angles to one another and intersect in one point, for example. Block 5, which in FIG. 2 has a rounded circumference in the sectional plane, for example in the direction of the cylinder has a height that may be smaller than the diameter of the tool piston 2, for example.

In the hydraulic drive H a through-hole 12 of the detent sleeve 11 simultaneously serves as pressure line and return line into and out of the cylinder 1. The through-hole 12 via inlets 13 and a bypass 17 of the valve insert 16 communicates with the pump port 6. Further, the return port extends from the through-hole 12 via the seat 18 of the pressure-limiting valve D in FIG. 2 upwards into the not shown reservoir. The detent sleeve 11 is loaded by a spring 14 toward the valve member 15. In the embodiment shown, the spring 14 is assigned to the end of the detent sleeve 11 facing the tool piston 2. Alternatively (not shown), the spring 14 could also be assigned to the opposite end of the detent sleeve 11. The spring 14 supports itself on or in block 5.

The valve member 15 of the pressure-limiting valve D has a neck 23 of a small diameter that is guided in the hole 24 in the valve insert 16, for example with a slide fitting; a cylindrical collar 22 having a larger diameter than the neck 23, as well as a shank 19 having a larger diameter than the neck 23. A conical sealing surface 20 is arranged on the shank 19 that cooperates with seat 18 at the upper end of the hole 25 in the valve insert 16. The valve member 15 is pressed by the spring 21 in the direction of the arrow into the closed position of the pressure-limiting valve shown in FIG. 2 onto the seat 18, namely against the pressure prevailing in the cylinder 1 that acts onto an annulus surface, resulting from the diameter of the seat 18 minus the diameter of the neck 10, via the through-hole 12 of the detent sleeve 11, a transverse passage 27 of the detent sleeve 11 and a clearance 26 between the shank 19 and the wall of the hole 25.

The valve member 15 penetrates the passage 27 of the detent sleeve 11. The purpose of the detent sleeve 11 is to lock the valve member 15 in the open position of the pressure-limiting valve D against the force of the spring 21 so that the hydraulic fluid at the return stroke of the tool piston 2 can unrestrained flow from the valve member 15 through the seat 18 rapidly into the reservoir.

Figure 2:
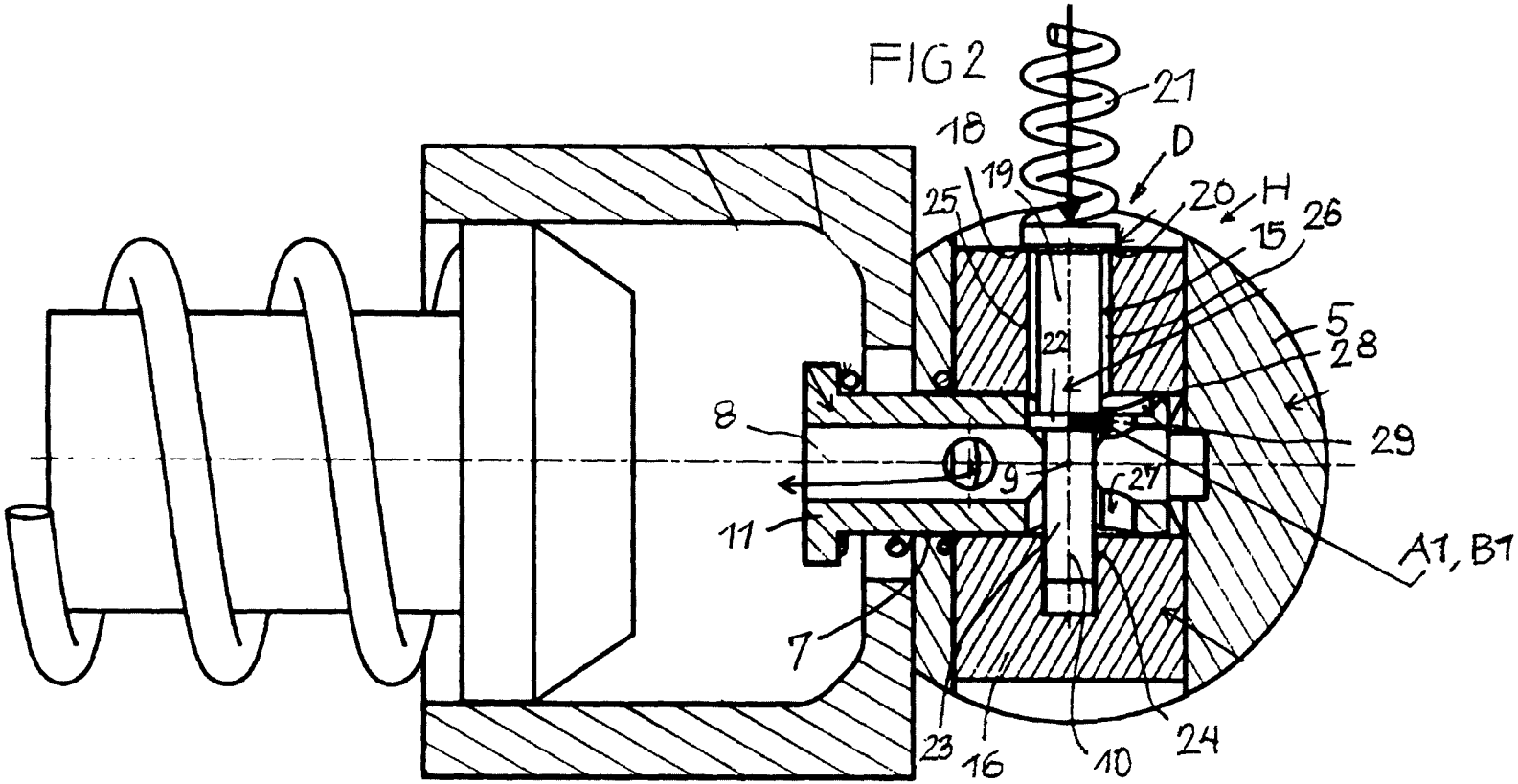
FIG. 2 shows a sectional view turned by 90° over FIG. 1 in the operating phase of FIG. 1.

FIGS. 1 and 2 show the pressure-limiting valve D in the closed position and the detent sleeve 11 in a released position in which the left end of the detent sleeve 11 penetrates the cylinder 1 less than in the open position of the pressure-limiting valve D and the locked position of the detent sleeve 11. In the open position shown in FIG. 3 the detent sleeve 11 protrudes into the cylinder 1 to such an extent that the tool piston 2 at its return stroke pushes out hydraulic fluid under the action of the return spring 3, but towards the end contacts the detent sleeve 11 in order to push it back into the released position shown in FIGS. 1 and 2 against the force of the spring 14 from the locked position shown in FIG. 3.

The passage 27 of the detent sleeve 11 for example is in the form of a keyhole and is explained in detail with reference to FIGS. 4 and 5. In the jacket of the detent sleeve 11 that faces the collar 22 of the valve member 15 there is formed a flattening 29 the even bottom of which includes the passage 27 and that is in parallel to the even bottom side of the collar 22. The passage 27 (FIGS. 4 and 5) in the embodiment shown is a transverse hole having at least the outer diameter of the cylindrical collar 22 of the valve member, wherein on a side of the cross hole in the flattening 29 an approximately semicircular recess 28 having the wall thickness of the detent sleeve 11 leads to the through-hole 12 and interrupts the transverse hole wall.

In FIGS. 1 and 2 a press cycle is initiated (hydraulic fluid flows according to the arrows in FIG. 1 in the cylinder 1), wherein the pressure-limiting valve D is in the closed position, the tool piston 2 moves to the left, and the detent sleeve 11 by the spring 14 with the transverse hole wall in the passage 27 is pressed to the cylindrical outer circumference of the collar 22.

Figure 3:
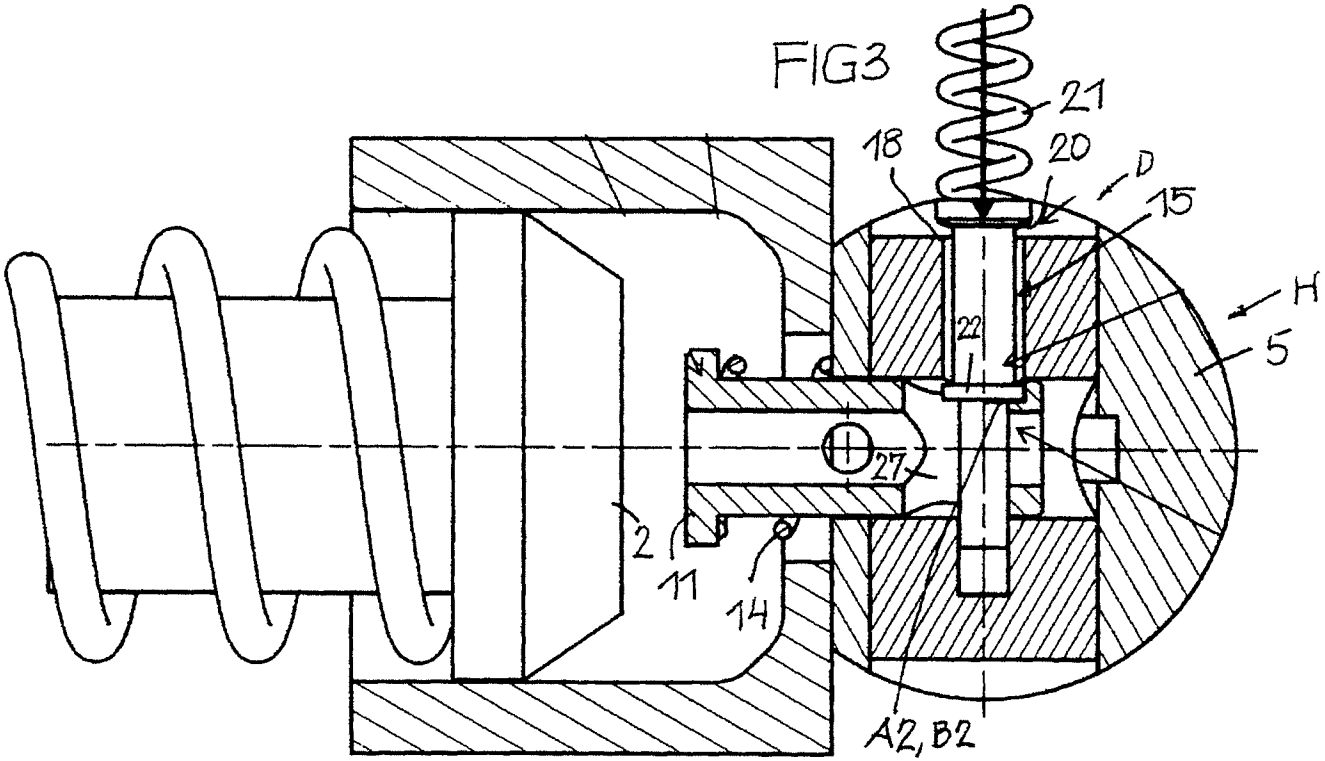
FIG. 3 shows a sectional view corresponding to FIG. 2, but in an operating phase after the pressing power has been reached.

On the other hand, in FIG. 3 the press operation is completed and the set pressing power has been achieved, wherein the pressure-limiting valve D went into the shown open position in which the sealing surface 20 was lifted from the seat 18 by a given opening stroke, and thereby the detent sleeve 11 slid into the locked position shown in FIG. 3 by the action of the spring 14 in which the bottom of the flattening 28 from two sides reaches under the parallel bottom side of the collar 22 and then, when the pressure in the cylinder 1 decreases, absorbs the force of the spring 21. Under the force of the return spring 3 the tool piston 2 with the pump being switched-off now performs its return stroke, thereby pushing hydraulic fluid out through the open pressure-limiting valve D into the reservoir. As soon as the tool piston 2 at the return stroke contacts the detent sleeve 11 this is pushed to the right with the bottom of the flattening 28 against the force of the spring 14 until the cross hole of the passage 27 aligns with the collar 22 and the valve member 15 is pressed by the spring 21 into the closed position according to FIG. 2 onto the seat 18. Thus, the tool piston 2 has completed its return stroke and is ready for a new press cycle.

The cylindrical outer circumference of the collar 22 on the valve member 15 as well as the even bottom side of the collar 22 form first and second flat contact areas A1, A2 of the valve member 15. The bottom of the flattening 28 and the wall of the cross hole of the passage 27 form first and second flat contact areas B1, B2 of the detent sleeve 11. The first contact area A1 of the valve member 15 approximately corresponds to half of the circumference of the collar 22 over its height and is a cylinder sub-surface. The first contact area B1 of the detent sleeve 11 in its curvature corresponds to the curvature of the outer circumference of the collar 22, so that in the released position of the detent sleeve 11 two cylinder sub-surfaces adapted to each other are contiguous under the force of the spring 14 (FIG. 1). The second flat contact area A2 of the valve member 15 is defined by the even bottom side of the collar 22 and corresponds to about half of an annulus. On the other hand, the second flat contact area B2 of the detent sleeve 11 is defined by the even bottom of the flattening 28 and the recess 29, and is in parallel to the bottom side of the collar 22, so that in the open position of the pressure-limiting valve D (FIG. 3) and the locked position of the detent sleeve in FIG. 3 on both sides of the valve member 15 there is symmetrical flat contact.

Figure 5:
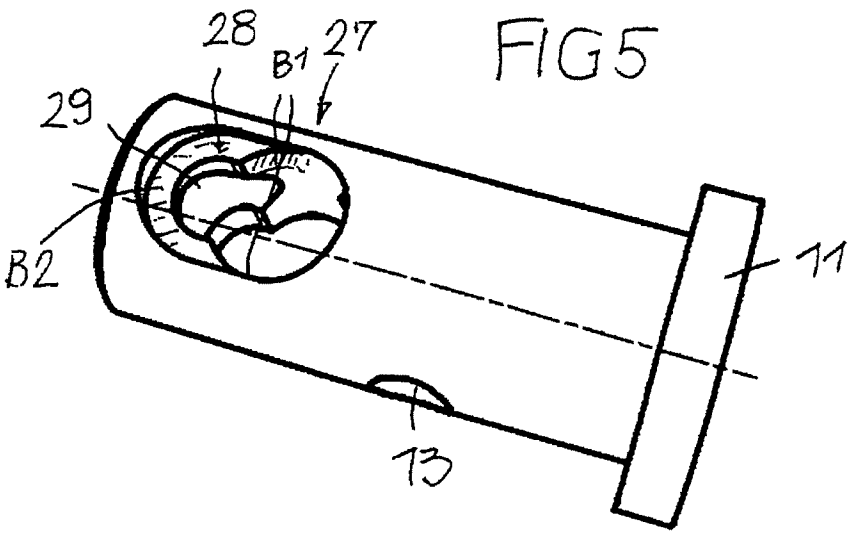
FIG. 5 shows a perspective plane view of the detent sleeve shown in FIG. 4.
Figure 4:
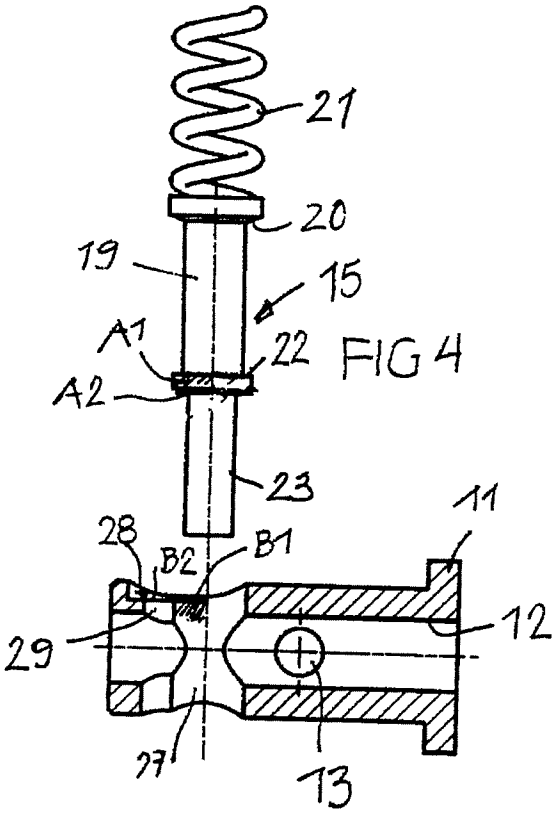
FIG. 4 shows a valve member of a pressure-limiting valve and a detent sleeve of the hydraulic drive.

In FIGS. 4 and 5 the first and second flat contact areas A1, A2 and B1, B2 of the valve member 15 and the detent sleeve 11 are partially brought out by hatchings. FIG. 5 in the perspective view shows the relative assignment of the first and second flat contact areas B1, B2 of the detent sleeve 11. Among the inlets 13 one is indicated in FIG. 5. Suitably, several inlets 13 are distributed in the circumferential direction of the detent sleeve 11 that may optionally also be offset to each other toward the axis of the detent sleeve 11.

The concept of the three axes 8, 9, 10 intersecting in one point at right angles reduces the size of the hydraulic drive H and offers advantages in production. The spring 21 of the pressure-limiting valve that is accessible on the block 5 (FIG. 2) allows the pressure-limiting valve, if necessary, to be moved manually to the closed position, provided that the detent sleeve 11 is in the position of FIG. 1.

The hysteresis of the pressure-limiting valve D is optimally low. The compact design of the hydraulic drive saves weight and above all length on the pressing tool W. Further, the chosen concept results in the single hydraulic interface 4 to the cylinder 1. The detent sleeve 11 fulfills a multiple function, because it functions both as pressure line and return line. The valve insert 15 is an easy-to-manufacture member and guides, centers and secures the valve member 15 and the detent sleeve 11. The positive locking of the valve member 15 in the open position of the pressure-limiting valve D is based on a surface contact. Also, when moving the valve member 15 from the closed position shown in FIG. 2 into the open position shown in FIG. 3 there is a surface contact, i.e., the detent sleeve 11 fitting under the force of the spring 14 ensures a constant friction on the valve member 15 over many press cycles, so that the pressure-limiting valve D always exactly opens at the set pressing power.

The valve member 15 has an optimally small diameter and acts with a relatively small annulus surface, while the detent sleeve 11 of a large diameter for the purpose of the large cross section of the passage receives the valve member 15 and makes the mentioned flat contacts. Also, when the second flat contact area B2 slips off the second flat contact area A2 over the edge of the collar 22 there is not generated a wear-promoting point contact, but a long line contact. The symmetric locking effect of the detent sleeve 11 at the valve member 15 like its transfer to the released position is always ensured. This increases the operational reliability of the hydraulic drive H.

While exemplary embodiments are described above, it is not intended that these embodiments describe all possible forms according to the disclosure. In that regard, the words used in the specification are words of description rather than limitation, and it is understood that various changes may be made without departing from the spirit and scope of the disclosure. Additionally, the features of various implementing embodiments may be combined to form further embodiments according to the disclosure.

What is claimed is:

1. A hydraulic drive of a tool piston in a cylinder that can be loaded against a return spring by a pump, the hydraulic drive comprising a pressure-limiting valve that can be loaded with pressure in the cylinder from a closed position to an open position against spring force, and a detent element, wherein the detent element is loadable by a spring to a locked position, to hold a valve member of the pressure-limiting valve lifted from a seat in the open position, wherein the detent element is arranged transversely to the valve member and can be moved from the locked position to a released position at least via the tool piston at its return stroke, wherein, in the locked position, the detent element is configured to support the valve member, and when the valve member is moving to the open position of the pressure-limiting valve, the detent element is configured to act on the valve member laterally, wherein when moving the valve member into its open position, or when the valve member is in its open position, contact areas of the detent element and the valve member are contiguous, and wherein the detent element comprises a longitudinally drilled cylindrical detent sleeve that is penetrated by the valve member in a transverse passage, and a through-hole of the detent sleeve forms a part of a pressure line and a part of a return line.

2. The hydraulic drive according to claim 1, wherein the contact areas comprise a flat contact area on each of the detent element and the valve member, and the flat contact areas are contiguous in the open position of the pressure-limiting valve and in the locked position of the detent element.

3. The hydraulic drive according to claim 1, wherein the contact areas comprise a partially cylindrical contact area on each of the detent element and the valve member, and the partially cylindrical contact areas are contiguous when the valve member is being moved to the open position of the pressure-limiting valve.

4. The hydraulic drive according to claim 1, wherein axes of a pump port, a housing hole for the detent element and a hole for the valve member intersect at right angles in one point, wherein the housing hole and the hole are arranged in a valve insert having the seat.

5. The hydraulic drive according to claim 4, wherein the valve insert is built into a hydraulic drive block containing the pump port and being connectable to the cylinder via a single hydraulic interface, and a bypass of the valve insert extends from the pump port to the through-hole.

6. The hydraulic drive according to claim 1, wherein the valve member has a guided neck of small diameter, a shank carrying a sealing surface and therebetween a collar having a diameter that is at least larger than that of the neck and having a cylindrical outer circumference, and can be displaced with the collar in the transverse passage of the detent sleeve.

7. The hydraulic drive according to claim 2, wherein the flat contact area on the detent sleeve is restricted by the transverse passage, a bottom of a flattening in a cylinder jacket of the detent sleeve and a recess in the flattening.

8. The hydraulic drive according to claim 6, wherein the transverse passage is a cross hole of a diameter that corresponds at least to the diameter of the collar, and an arc curvature of a cross hole side having a wall thickness of the detent sleeve corresponds to a cylinder curvature of the outer circumference of the collar and forms a contact area of the detent sleeve.

9. The hydraulic drive according to claim 2, wherein axes of a pump port, a housing hole for the detent sleeve and a hole for the valve member intersect at right angles in one point, wherein the housing hole and the hole are arranged in a valve insert having the seat.

10. The hydraulic drive according to claim 9, wherein the detent sleeve is guided without a seal with a slide fitting in the housing hole.

11. The hydraulic drive according to claim 4, wherein the valve member has a guided neck of small diameter, a shank carrying a sealing surface and therebetween a collar having a diameter that is at least larger than that of the neck and having a cylindrical outer circumference, and can be displaced with the collar in the transverse passage of the detent sleeve.

12. The hydraulic drive according to claim 11, wherein in the valve insert between the shank of the valve member and the hole for the valve member a space forms a further part of the return line up to the seat.

13. The hydraulic drive according to claim 11, wherein of the seat in the valve insert is larger than the diameter of the neck of the valve member guided in the hole.

14. The hydraulic drive according to claim 5, wherein the spring loading the detent element is assigned to an end of the detent element that protrudes into the cylinder or another end facing away from the cylinder and is supported in the block.

15. The hydraulic drive according to claim 1, wherein the detent sleeve has inlets to the through-hole that are distributed in a circumferential direction and offset to each other toward an axis of the detent sleeve.

16. The hydraulic drive according to claim 1, wherein height of the hydraulic drive seen in a longitudinal direction of the cylinder is smaller than a diameter of the tool piston.

17. A hydraulic drive for a tool piston in a cylinder that can be loaded against a return spring by a pump, the hydraulic drive comprising:

a pressure-limiting valve that can be loaded with pressure in the cylinder from a closed position to an open position against spring force; and a detent element that is loadable by a spring to a locked position, to hold a valve member of the pressure-limiting valve lifted from a seat in the open position, wherein the detent element is arranged transversely to the valve member and can be moved from the locked position to a released position at least via the tool piston at its return stroke, wherein, in the locked position, the detent element is configured to support the valve member, and when the valve member is being moved to the open position of the pressure-limiting valve, the detent element is configured to act on the valve member laterally, wherein when the valve member is in the open position of the pressure-limiting valve, flat contact areas of the detent element and the valve member are contiguous, and wherein the detent element comprises a cylindrical detent sleeve that is penetrated by the valve member in a transverse passage, and a through-hole of the detent sleeve forms a part of a pressure line and a part of a return line.

18. A tool comprising the hydraulic drive of claim 17.

19. A hydraulic drive for a tool piston in a cylinder that can be loaded against a return spring by a pump, the hydraulic drive comprising:

a pressure-limiting valve that can be loaded with pressure in the cylinder from a closed position to an open position against spring force; and a detent element that is loadable by a spring to a locked position, to hold a valve member of the pressure-limiting valve lifted from a seat in the open position, wherein the detent element is arranged transversely to the valve member and can be moved from the locked position to a released position at least via the tool piston at its return stroke, wherein, in the locked position, the detent element is configured to support the valve member, and when the valve member is being moved to the open position of the pressure-limiting valve, the detent element is configured to act on the valve member laterally, wherein when the valve member is in its open position, flat contact areas of the detent element and the valve member are contiguous;

wherein axes of a pump port, a housing hole for the detent element and a hole for the valve member intersect at right angles at one point, wherein the housing hole and the hole for the valve member are arranged in a valve insert having the seat, and wherein the valve insert is built into a hydraulic drive block containing the pump port and being connectable to the cylinder via a single hydraulic interface, and a bypass of the valve insert is configured to communicate with the pump port and the through-hole.

20. A tool comprising the hydraulic drive of claim 19.

* * * * *